US007637352B2

(12) United States Patent
Al-Fayez

(10) Patent No.: US 7,637,352 B2
(45) Date of Patent: Dec. 29, 2009

(54) CIRCUIT FOR CONTROLLING AN ELEVATOR

(76) Inventor: Dheya Ali Al-Fayez, P.O. Box 12111, Shamia 71652 (KW)

( * ) Notice: Subject to any disclaimer, the term of this patent is extended or adjusted under 35 U.S.C. 154(b) by 423 days.

(21) Appl. No.: 11/533,869

(22) Filed: Sep. 21, 2006

(65) Prior Publication Data

US 2008/0073159 A1 Mar. 27, 2008

(51) Int. Cl.
*B66B 3/00* (2006.01)
*B66B 5/14* (2006.01)
*B66B 1/34* (2006.01)

(52) U.S. Cl. ..... 187/281; 187/391; 187/394

(58) Field of Classification Search ..... 187/281, 187/290, 292, 391–394, 411; 177/132
See application file for complete search history.

(56) References Cited

U.S. PATENT DOCUMENTS 5,004,076 A * 4/1991 Chen et al. ..... 187/391
5,402,861 A * 4/1995 Kohara ..... 187/292
5,435,416 A * 7/1995 Siikonen et al. ..... 187/392
5,663,538 A * 9/1997 Sakita ..... 187/382
5,767,461 A * 6/1998 Nakagawa et al. ..... 187/382
5,894,910 A * 4/1999 Suur-Askola et al. ..... 187/290
5,984,052 A * 11/1999 Cloux et al. ..... 187/404
6,021,873 A * 2/2000 Aulanko et al. ..... 187/411
6,286,628 B1 * 9/2001 Lee ..... 187/393
6,328,134 B1 * 12/2001 Hikita ..... 187/382
6,435,312 B2 * 8/2002 Tajima et al. ..... 187/290

FOREIGN PATENT DOCUMENTS

JP 01069479 A * 3/1989

* cited by examiner

*Primary Examiner*—Walter Benson
*Assistant Examiner*—Eduardo Colon-Santana
(74) *Attorney, Agent, or Firm*—Lowe Hauptman Ham & Berner, LLP

(57) ABSTRACT

An elevator control system for controlling the movement of an elevator car up and down an elevator shaft between floors of a structure includes a call input device provided on each floor to indicate a passenger is waiting to be picked-up; a measuring device to indicate a load on the elevator car; and a controller to answer calls from the call input devices and move the elevator between floors, wherein the controller overrides calls received from the call input devices and does not stop the car to pick up passengers when the load indicates there a full car with no room for additional passengers. The measuring device may include a force transducer to measure the load on the elevator car. The load may be a measure of the number of passengers in the car. The load may be compared to a threshold and when the load exceeds the threshold a signal is provided to the controller to override the call input devices. The controller answers calls from the call input devices and stops the elevator to pick up passengers when the load indicates the car is not full and has room for passengers. The measuring device also may include a force transducer connected to an amplifier circuit connected to an over voltage protection circuit, wherein an output of the over voltage protection circuit is provided to the controller to indicate a full car with no room for additional passengers.

2 Claims, 5 Drawing Sheets

CIRCUIT FOR CONTROLLING AN ELEVATOR

TECHNICAL FIELD

The following description relates generally to elevator control and more particularly to control full elevators.

BACKGROUND

Automatic elevator controls typically include a selector for generating a signal representing the next floor along the path of travel of the elevator at which the elevator could stop. These controls also include a circuit for comparing the selector signal with floor calls stored in a memory. When a floor call and the selector signal match, the control signals the elevator to stop. When an elevator is full it still stops if a call indicated that there are passengers waiting to be picked up; however, there is no space available and time is wasted while waiting for the doors to close and the elevator to resume travel. As a result, a more efficient system for elevator control is needed.

SUMMARY

In one general aspect, an elevator control system for controlling the movement of an elevator car up and down an elevator shaft between floors of a structure includes: a call input device provided on each floor to indicate a passenger is waiting to be picked-up; a measuring device to indicate a load on the elevator car; and a controller to answer calls from the call input devices and move the elevator between floors, wherein the controller overrides calls received from the call input devices and does not stop the car to pick up passengers when the load indicates there a full car with no room for additional passengers.

The measuring device may include a force transducer to measure the load on the elevator car. The load may be a measure of the number of passengers in the car. The load may be compared to a threshold and when the load exceeds the threshold a signal is provided to the controller to override the call input devices. The controller answers calls from the call input devices and stops the elevator to pick up passengers when the load indicates the car is not full and has room for passengers. The measuring device also may include a force transducer connected to an amplifier circuit connected to an over voltage protection circuit, wherein an output of the over voltage protection circuit is provided to the controller to indicate a full car with no room for additional passengers.

In another general aspect, an elevator measuring circuit includes: one or more inputs to sense force exerted on an elevator car; a force transducer to measure the force; a circuit to determine that the car is full and should not stop to pick up passengers based on the measured force; and an output to provide a signal from the circuit that the car is full.

In yet another general aspect, an elevator car includes: a housing assembly including doors to pickup passengers for travel between floors of a structure; and a measuring device to determine the capacity of the elevator car, the measuring device including: one or more inputs to sense force exerted on an elevator car by the passengers, a force transducer to measure the force; a circuit to determine that the car is full and should not stop to pick up passengers based on the measured force; an output to provide a signal from the circuit that the car is full.

Other features will be apparent from the description, the drawings, and the claims.

DESCRIPTION OF DRAWINGS

Like reference symbols in the various drawings indicate like elements.

DETAILED DESCRIPTION

Figure 1:
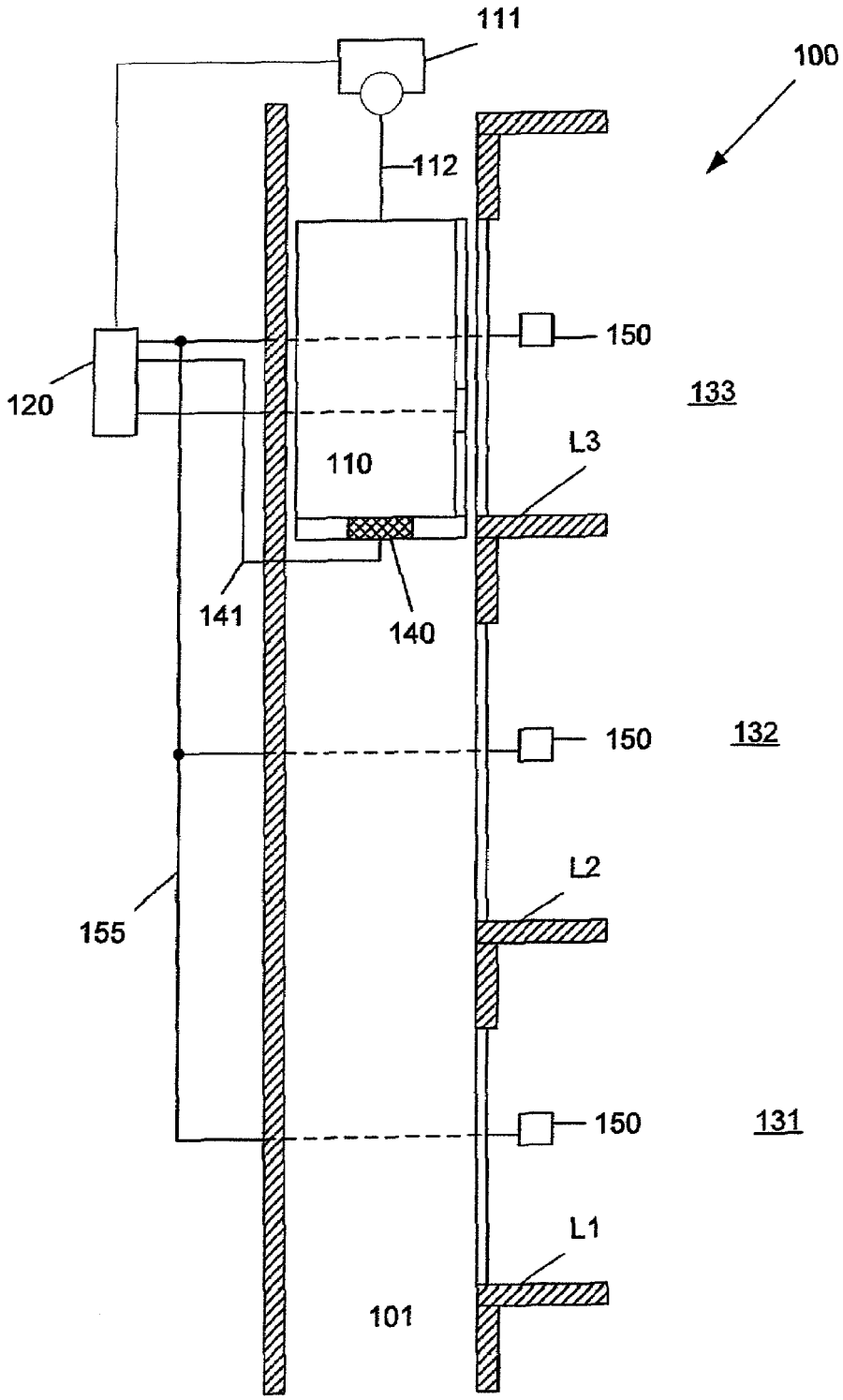
FIG. 1 is a schematic representation of a portion of an elevator control system.

FIG. 1 is a schematic representation of a portion of an elevator control system including an elevator shaft 101 and elevator car 110 that is raised an lowered in the shaft 101 by a motor/winch assembly 111 and a cable 112 under control of an elevator control system 120. As shown in FIG. 1, an elevator shaft 101 serves a plurality of floors (e.g., 131, 133, and 135) at a landing for each of the floors, such as landings L1, L2, and L3 (representing three adjacent floors). Of course, one skilled in the art will appreciate that the system 101 is for illustrative purposes only and that the concepts and teachings described herein may be used to control any number of floors, shafts, and elevator cars. The elevator shaft 101 guides an elevator car 110 which is suspended from the cable 112 connected to the motor and winch equipment assembly 111 to move the elevator up and down the elevator shaft 101.

The elevator car 110 includes a load measuring device 140. The load measuring device 140 may be used to determine the number of passengers in the elevator car 110. The load measuring device 140 may be implemented using any device that determines a load placed on the elevator car 110 by passengers in the car. In one exemplary implementation, the device 140 may be implemented using a force transducer, such as a load cell (in addition to an amplification circuit and over-voltage protector as described in further detail below). The load measuring device 140 is connected to the control system 120 by a communication path 141 to send measurement signals to the control system 120. The control system 120 may implemented using a processor, microcomputer, or microcontroller, or integrated circuits, or, alternatively, hardwired logic also may be used. The communications path 141 may be implemented using any medium configured to send and receive signals (e.g., electrical, electromagnetic, or optical) that convey or carry signals representing various types of analog and/or digital data and information.

A call input device 150 is located at each of the floors 131-135. Each call input device 150 includes a means to register a call to the control system 120 for an elevator car 110 to allow passengers to travel to a destination floor. For example, the call input device 150 may include two or more buttons, such as, for example, an up button and a down button. A passenger selects a button to initiate a call and indicate a direct of desired travel. The call input device 150 is connected to the control system 120 by a communications path 155 which may be implemented using any medium configured to send and receive signals (e.g., electrical, electromagnetic, or optical) that convey or carry signals representing various types of analog and/or digital data and information. Calls may be input into a memory device (not shown) of the control system 120. The call is stored by the control system 120 until an elevator car 110 stops at the floor to pick up one or more waiting passengers. As calls are inputted on each of the floors, the control system 120 controls the motor assembly 111 to move the elevator car 110 to a destination in addition to stopping to answer calls and pick up passengers.

As passengers board and disembark the elevator car, the elevator fills and empties. However, if the elevator car 110 fills to capacity then no additional passengers are able to board the elevator car 110 (even if the elevator stops to answer a call). As a result, it is more efficient to stop and answer a call only if the evaluator car 110 has the space to accept additional passengers.

To provide efficient operation of the elevator system 100, the output of the measuring device 140 is connected to the control system 120 using a communications path 141. The control system 120 receives the output from the measuring device 140 and uses the output to determine whether the elevator car 110 is full or if it able to take on more passengers based on the load sensed by the measuring device 140. If the elevator is full, the controller 120 does not stop the elevator car 110 during its travel of the elevator shaft to a destination until additional space for passengers is available. For example, the control system 120 may compare the signal to a threshold level. If the signal is greater than the threshold, the car is determined to be full and does not answer calls until space becomes available. If the signal is below a threshold, the car may answer calls and take on passengers. In yet another example, the output signal from the measuring device 140 may be used directly as an indication to override the call buttons. For example, the control system 120 may monitor the communication path 141 for a high voltage signal and whenever a high voltage signal is detected, the control system 120 may override the call buttons until the elevator car 110 is able to take on passengers. Of course the maximum load used to determine the threshold or high voltage state is determined base on the specific type of elevator car 110 used and its corresponding capacity or safe load, as may be determined by one skilled in the art.

Figure 2:
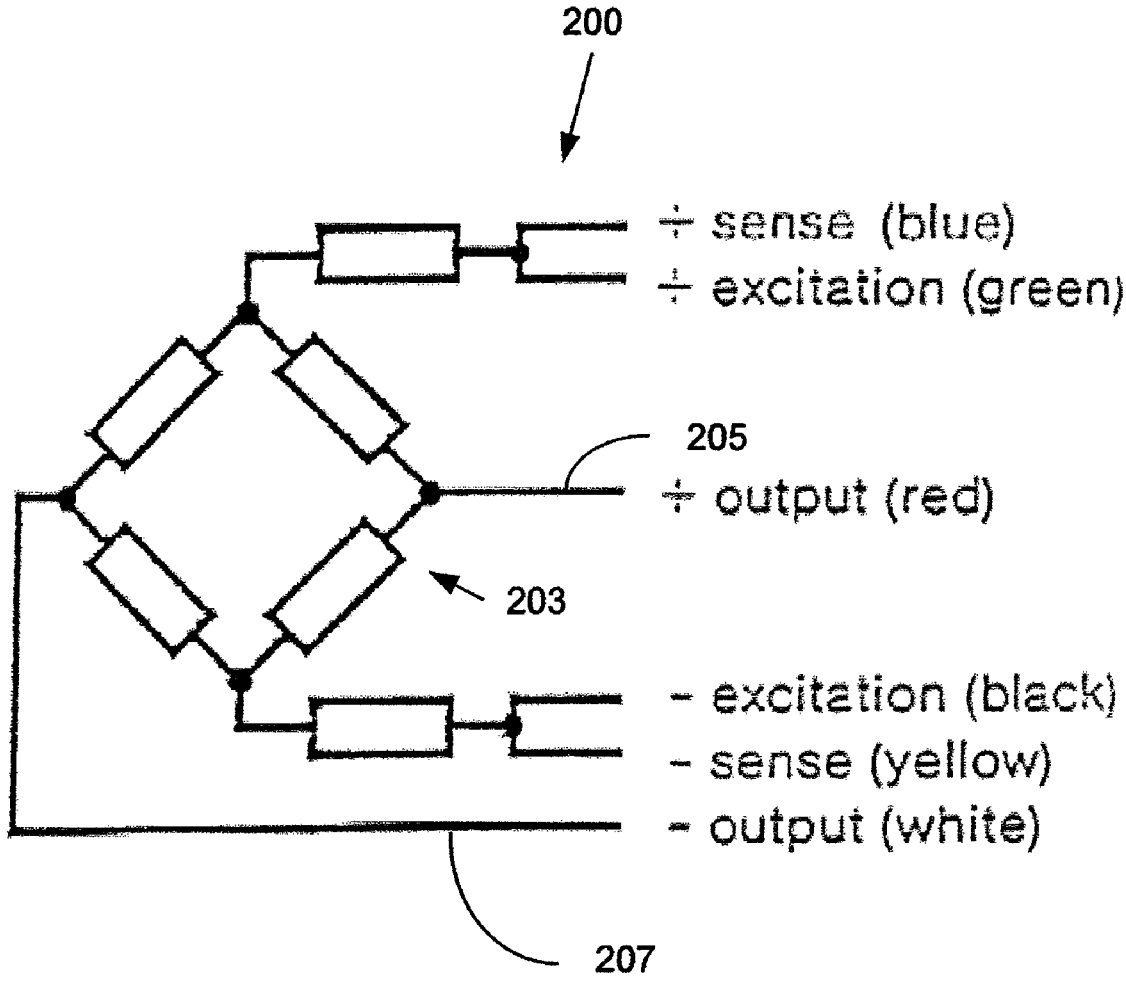
FIG. 2 is an exemplary force transducer for use in the system of FIG. 1.
Figure 5:
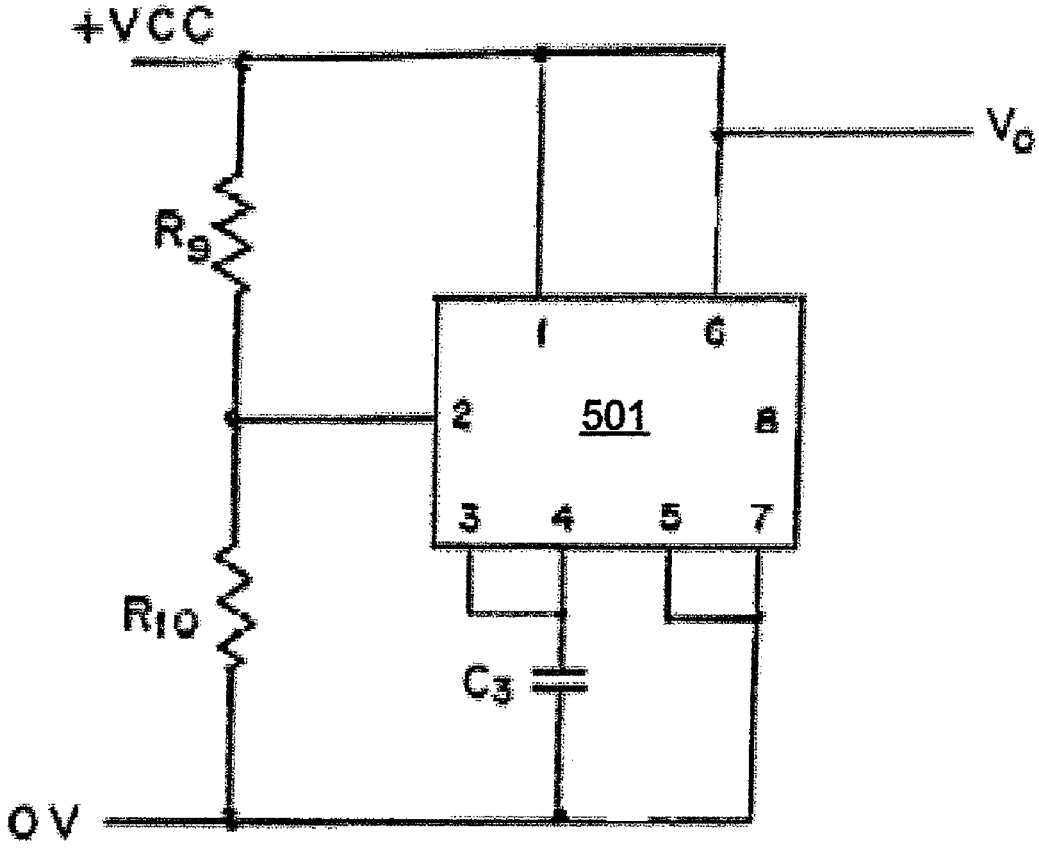
FIG. 5 is an exemplary over-voltage circuit for use with amplifier circuit of FIG. 4.

FIG. 2 is an exemplary measurement device 140 for use in the system of FIG. 1. The measurement device 140 may be implemented using a strain sensor, tension/compression load cell which may be positioned in the floor of an elevator car to provide measurements that are indicative of the number of passengers on board the car 110. In one implementation, as shown in FIG. 2 a force transducer 200 may be used. The force transducer 200 is a device that measures a physical quantity and converts it into an electrical signal. In addition, as an over voltage protector circuit (as shown in FIG. 5) may be used to convert the output voltage to an audio/visual signal. The force transducer 200 may be used for force (load) measurement as such mass determinations (weighing) force that is the vector quantity necessary to a change in momentum when an unbalanced force acts on a body. The body (in this case the car with its passengers) accelerates in the direction of the force. The acceleration is directly proportional to the unbalanced force and inversely proportional to the mass of the body. As is well known, force is related to mass and acceleration as given by Newton's Second law: F=m a which is expressed in the absolute system of units as F=kma.

where:

F=force m=mass a=acceleration k=proportionality constant.

Mass is the inertial property of a body and is the measure of the quantity of matter in a body and of the resistance to change in motion of the body. Weight is the gravitational force of attraction on earth and is the force with which a body is attracted toward the earth.

Figure 3:
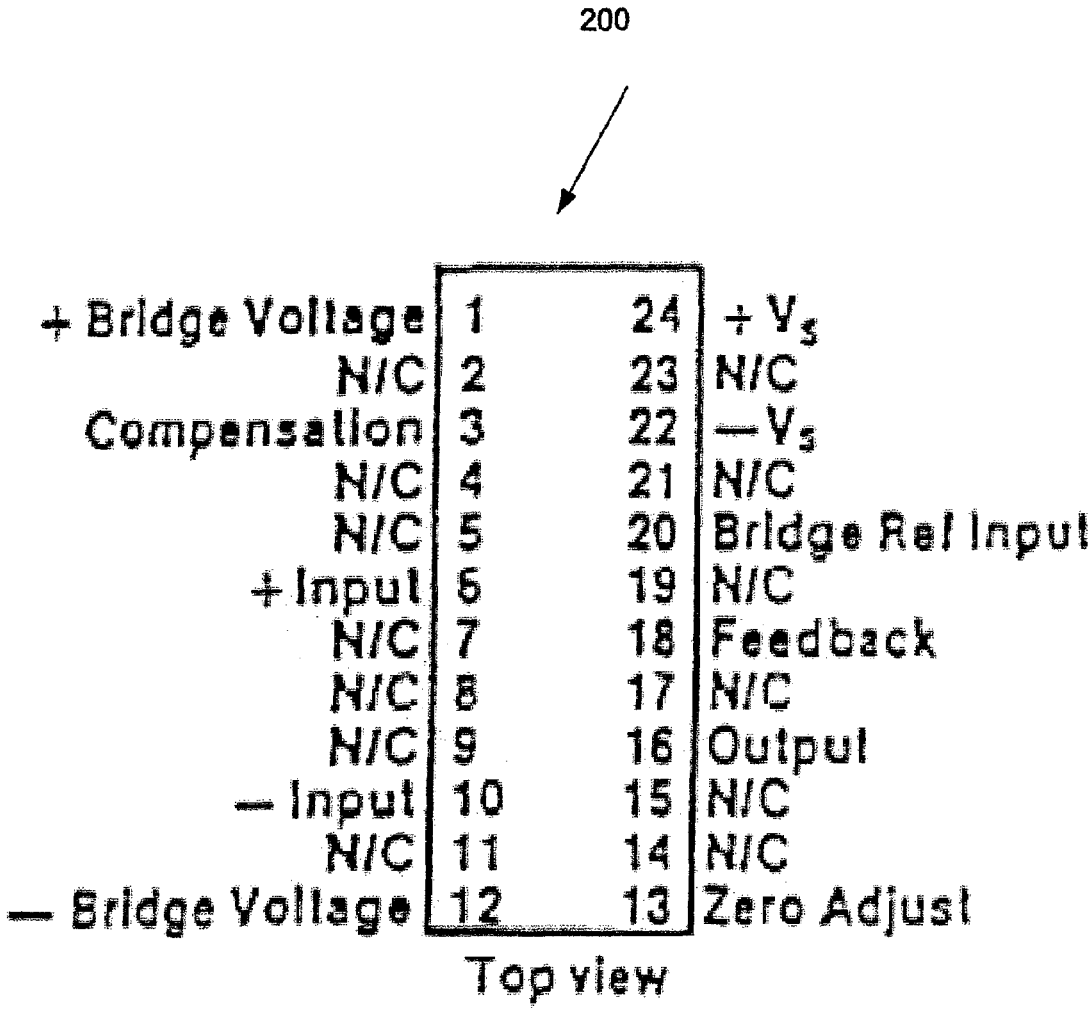
FIG. 3 is an exemplary strain gauge amplifier for use in with the force transducer of FIG. 2.
Figure 4:
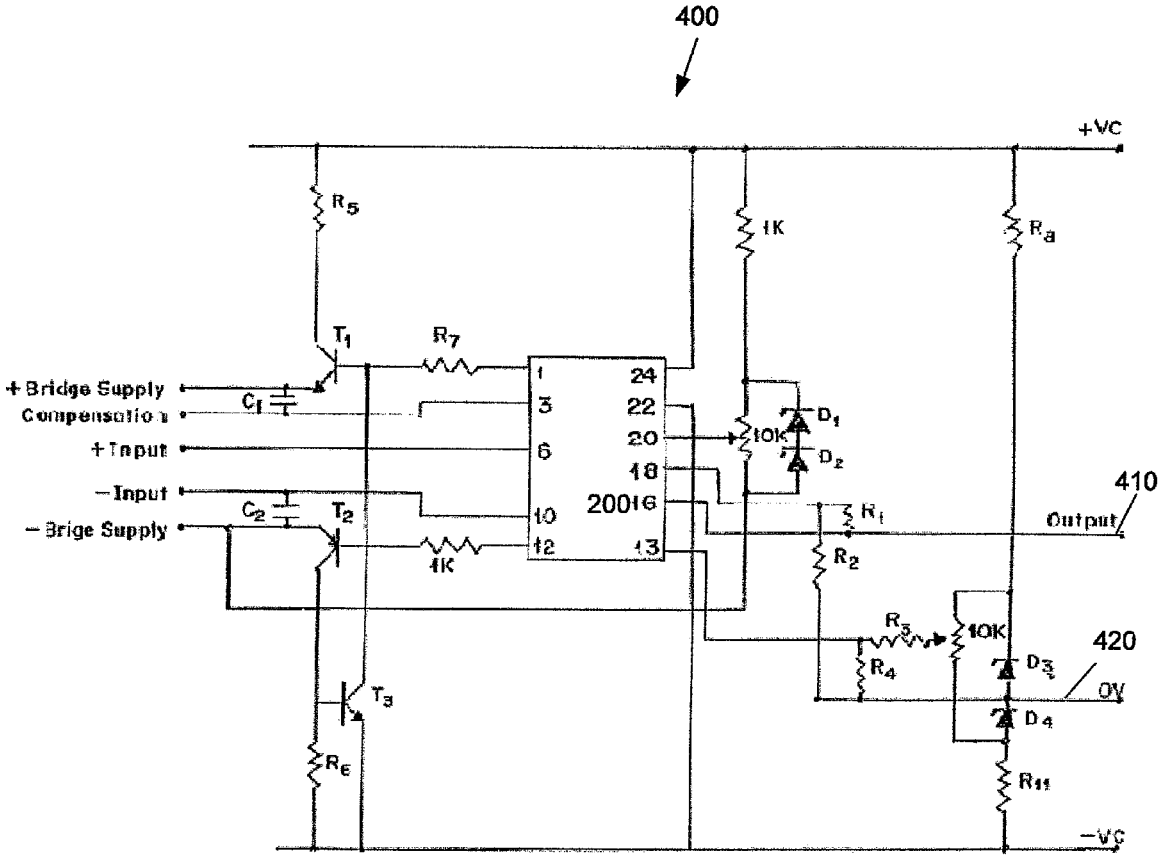
FIG. 4 is an exemplary portion of a amplifier circuit for use with the force transducer of FIG. 2.

The force transducer 200 employs sensing elements that convert the applied force into a deformation of an elastic element. The deformation is then converted into an output signal by a transduction element. Two characteristics of elasticity are used to sense force: local strain and gross deflection. A maximum level of each occurs at some point in the sensing element. The transduction element that is used may be of either type (i.e., of the type that responds to strain or of the type that responds to deflection). As shown in FIG. 2, the force transducer includes 4 strain gauges (not shown) connected to the inputs to a full or Wheatstone bridge 203. The bridge 203 provides two outputs 205, 207 (positive and negative) to provide a voltage difference generated by the bridge that indicate the force placed on the force transducer 200 by the passengers within the elevator car 110. The force transducer 200 may be placed, for example, in a location relative to the floor of the elevator car 110 such that deflection of the floor may be used to sense the force exerted by a number of passengers riding in the car 110. Of course the deflection and force sensed may be tailored and/or calibrated based on the expected load and capacity of the particular car in which the force transducer is installed. The voltage differential from outputs 205 and 207 are provided to a strain gauge voltage differential amplifier 300 as shown in FIG. 3 to amplify the signal received from the force transducer. In one example, the strain gauge amplifier 300 may be implemented using a hybrid, low noise, low drift, linear DC amplifier in a 24 pin DIL package which may be specifically configured for resistive bridge measurement. The strain gauge amplifier 300 may be connected as shown in FIG. 4 to provide an amplification circuit 400. The positive and negative bridge supply voltages of the force transducer 200 are provided to pins 1 and 12 of the strain gauge amplifier 300 via two switches (i.e., transistors T1 and T2) and resistors R7 and R7.5, respectively. The positive and negative output from the force transducer is connected to the pins 6 and 10 of the strain gauge amplifier 300, respectively. The strain gauge amplifier circuit 400 may be used to overcome any common mode rejection by removing common mode voltages by controlling the negative bridge supply voltage in such a manner that the voltage at the negative input terminal is always zero. Thus for the symmetrical bridge used in the force transducer of FIG. 2, a negative bridge supply is generated equal and opposite to the positive bridge supply thereby providing a zero common mode voltage. An amplified differential output that indicates a measure of the force on the elevator car 110 is provided at outputs 410 and 420.

FIG. 5 is an exemplary over voltage protector circuit 500 for use with amplifier circuit of FIG. 4. An over voltage protector circuit typically is used to protect sensitive electronic circuitry. In this implementation, the circuit 500 may be used to indicate a threshold condition which indicates the car is full and should not pick up passengers. As shown the circuit 500 includes an integrated circuit 501 connected to the outputs 410 and 420 of the amplifier circuit 400 in a voltage divider configuration with resisters R9 and R10. When the amplifier circuit outputs a certain voltage, the IC 501 will provide a voltage on Vo pin 6 indicating that the car 110 should not pick up passengers. This signal may be provided to the control system 120 to indicate the control system should not stop the car 110 to answer calls.

A number of exemplary implementations have been described. Nevertheless, it will be understood that various modifications may be made. For example, suitable results may be achieved if the steps of described techniques are performed in a different order and/or if components in a described components, architecture, or devices are combined in a different manner and/or replaced or supplemented by other components. Accordingly, other implementations are within the scope of the following claims.

What is claimed is:

1. An elevator control system for controlling the movement of an elevator car up and down an elevator shaft between floors of a structure comprising:

a call input device provided on each floor to indicate a passenger is waiting to be picked-up;

a measuring device to indicate a load on the elevator car;

a controller to answer calls from the call input devices and move the elevator between floors, wherein the controller overrides calls received from the call input devices and does not stop the car to pick up passengers when the measuring device indicates a load indicative of a full car with no room for additional passengers;

wherein the measuring device includes a force transducer connected to an amplifier circuit connected to an over voltage protection circuit, wherein an output of the over voltage protection circuit is provided to the controller to indicate a full car with no room for additional passengers; and wherein a Wheatstone bridge provides a voltage difference generated by the Wheatstone bridge that indicates the force placed on the force transducer by the passengers within the elevator car.

2. The system of claim 1 wherein the measured force is compared to a threshold by the circuit and when the measured force exceeds the threshold the output signal is provided to a controller to override call input devices.

* * * * *